United States Patent [19]

Stolzer

[11] 4,021,936

[45] May 10, 1977

[54] PICTURE KIT

[76] Inventor: Myron M. Stolzer, 130 Bud Lane, Levittown, N.Y. 11756

[22] Filed: Aug. 4, 1975

[21] Appl. No.: 601,503

[52] U.S. Cl. ..... 35/26; 24/90 HA; 156/63; 428/18

[51] Int. Cl.[2] ..... A44B 1/18

[58] Field of Search ..... 24/90 HA, 90 TA; 35/15, 35/26, 27; 156/63; 428/39, 18

[56] References Cited

UNITED STATES PATENTS

| | | | |
|---|---|---|---|
| 308,626 | 12/1884 | Pike | 428/39 |
| 356,005 | 1/1887 | Modini | 40/152.1 |
| 1,220,097 | 3/1917 | Grundy | 156/63 |
| 1,619,541 | 3/1927 | Rehor | 24/90 TA |
| 1,715,420 | 6/1929 | Mayer | 112/266 X |
| 2,189,067 | 2/1940 | Hlavaty | 24/90 HA UX |
| 2,588,321 | 3/1952 | Hahn | 35/26 X |
| 3,041,778 | 7/1962 | Seron | 156/63 UX |
| 3,816,200 | 6/1974 | McKenna | 24/90 TA X |
| 3,846,214 | 11/1974 | Rosenzweig | 35/27 X |

FOREIGN PATENTS OR APPLICATIONS

| | | | |
|---|---|---|---|
| 1,219,496 | 1/1971 | United Kingdom | 428/323 |

OTHER PUBLICATIONS

Steve Ellingson, "Raggedy Darlings," Washington Post, Feb. 10, 1973, p. D6.

Craft Master Kits, Mar. 1970, Playthings, pp. 242, 243.

Steve Ellingson, "Recycle Junk," Milwaukee Sentinel, Aug. 17, 1974, p. 6, part 4.

*Primary Examiner*—Harland S. Skogquist

*Attorney, Agent, or Firm*—Natter & Natter

[57] ABSTRACT

A picture kit for providing entertainment and for furthering development of arts and crafts skills. The picture kit has a selection of picture rendering cards and is equipped with art supplies, such as drawing and coloring implements, for composing a picture or design on the card surface. A plurality of buttons are included and adapted for selective attachment to the card surface to complete the art work. The buttons are furnished in different sizes, shapes and colors and have various surface contours for creating unusual visual effects.

1 Claim, 6 Drawing Figures

PICTURE KIT

BACKGROUND OF THE INVENTION

1. Field of the Invention

This invention relates to educational and amusement devices and especially to a craft work apparatus and game as contained in a picture construction kit.

The picture construction kit of this invention is concerned with the development of arts and crafts skills through the composition of art work using buttons and is particularly adapted for providing creative play activity, entertainment, rehabilitation therapy and can further be suitably utilized for other applications.

2. Description of the Prior Art

Although the concept of developing and expanding arts and crafts skills within a construction game environment has been previously introduced, the presently known games of this type have not been able to provide a wide scope of creative independence by the user. Frequently such games are limited in the amount of creative interplay and by other limitations. Additionally, prescribed guide lines or directions as to how, where and what colors are to be applied on designated areas on a picture critically restrict the freedom of creative expression.

The present invention solves many of these shortcomings but providing only the barest minimum suggestion for the composing of a picture or design. The picture kit of this invention not only includes a wide variety of coloring implements by also provides decorative articles or objects, such as buttons, which can be attached using glue or thread in various manners to complement or complete the art work.

Although the utilization of unconventional art materials has been used before in picture construction games, these games generally rely on a tedious and repetitive, basically mechanical, operation for attaching objects, and a person soon loses interest. Further, these games do not achieve the esthetic and artistic effects in the finished art work as with the instant invention. In addition, the technique of the present invention provides an improved bonding between buttons and backing card.

BRIEF SUMMARY OF THE INVENTION

The picture kit of this invention provides in one compact package all the supplies and materials needed for composing a picture or design. The kit contains a plurality of picture cards; each of these cards can bear a faintly sketched suggestion of a picture form or a mere outline. After the user becomes familiar with the method and procedure of creating the art work, cards may be provided which are completely blank. Further materials are supplied, such as paints, crayons, small objects, paste or glue, and thread, for completing the picture whereby the user can selectively utilize one or more of such materials at his own discretion.

An important aspect of this invention includes the feature whereby these small objects can be affixed to the picture card so as to complete or finish the picture with a dimensionally textured effect. This is accomplished through the use of various colored buttons having distinctive shapes and surface contours. The buttons can be attached to the card by using viscous adhesives, such as paste or glue, thus forming a collage.

A positive bonding of the buttons is achieved by the flow of the adhesive into the buttonhole or aperture.

Consequently there is less tendency for the buttons to become loose or fall off the completed picture. The buttons can additionally be affixed by use of the thread passing through the card and the respective buttonholes. In this manner the buttons can be attached in a stacked, overlapping, or in a contiguous relationship. The techniques for creatively completing the picture in an imaginative manner, as so described, and in particular by using the buttons will result in an original art work having an unusual and esthetically appealing appearance.

It is an object, therefore, of this invention to provide a picture kit of the general character described herein.

Specifically, it is an object of this invention to provide a picture kit for developing creative arts and crafts skills by making original pictures and designs incorporating buttons into the finished work.

Still another object of this invention is to provide a picture kit including a technique for affixing the buttons to achieve a positive locking action by the flow of an adhesive through or into the buttonhole.

A further object of this invention is to provide a picture kit including a technique for affixing the buttons to achieve a positive locking action by using a length of thread passing through the buttonhole and card.

The above and other objects, features and advantages of this invention will be apparent from the following description of the preferred embodiments when considered in connection with the accompanying drawings.

BRIEF DESCRIPTION OF THE DRAWINGS

In the accompanying drawings in which are shown some of the preferred embodiments of the invention.

DESCRIPTION OF THE PREFERRED EMBODIMENT

Figure 1:
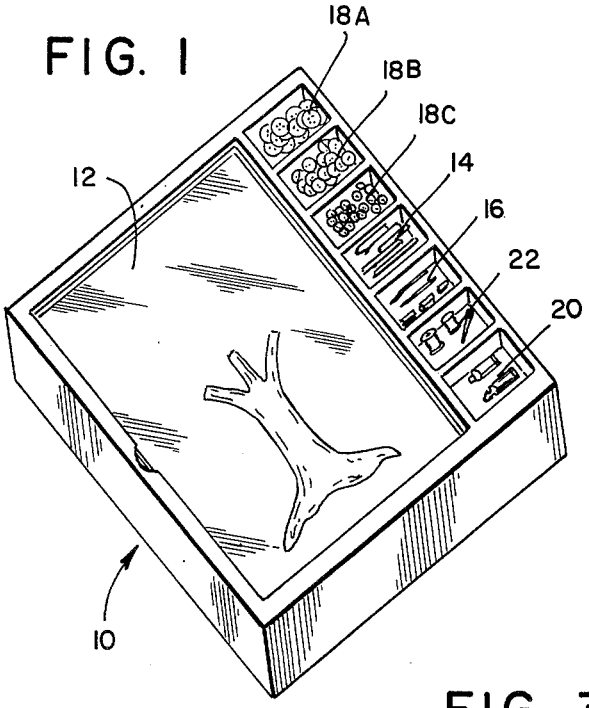
FIG. 1 is a perspective view of the picture kit of this invention showing a typical picture rendering card and a typical compartmentalized container or box having art supplies and construction materials for completing a picture or design in accordance with the technique of this invention.

Referring now in detail to the drawings, the reference numeral 10 denotes generally a picture kit of this invention. The kit 10 is designed to provide educational entertainment and to promote arts and crafts skills. Accordingly, the kit 10 in the illustrated embodiment shown in FIG. 1 provides a convenient package for containing the necessary arts supplies and crafts materials for composing a picture in accordance with this invention.

The picture kit 10 of this device includes a plurality of picture rendering cards 12. The cards 12 can be made of a smooth surface drawing paper, cardboard, canvas, etc. The suggestion or bare outline of a picture is preferably lightly inscribed on the card 12. It should be apparent that each card 12 could contain a different picture outline and further that some of the cards can be left blank where the picture to be produced would be left entirely to the creative imagination of the user.

As illustrated in FIG. 1 a compartmentalized section of kit 10 is provided for holding various art supplies and materials, such as a variety of drawing implements 14, a plurality of different color paints and brushes 16, a supply of decorative objects such as buttons denoted generally by reference numeral 18 and referred to more specifically by color and size as 18A, 18B, 18C. The buttons 18 are provided with conventional apertures or buttonholes 19. Additionally included is an adhesive 20 for attaching the buttons and a supply of thread 22 for use in an alternate method of attaching the buttons 18.

Figure 2:
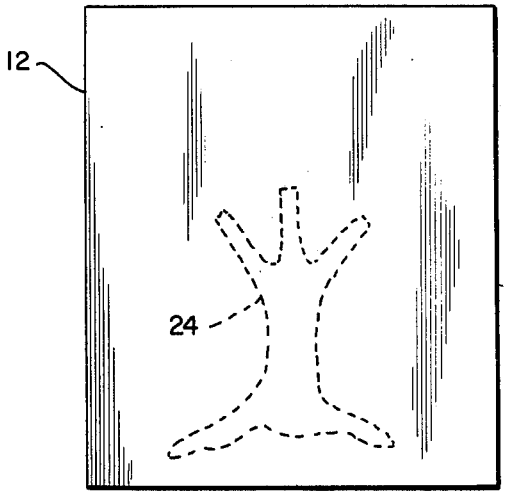
FIG. 2 shows a typical picture rendering card indicating a general basic outline for creating a picture of a tree.
Figure 3:
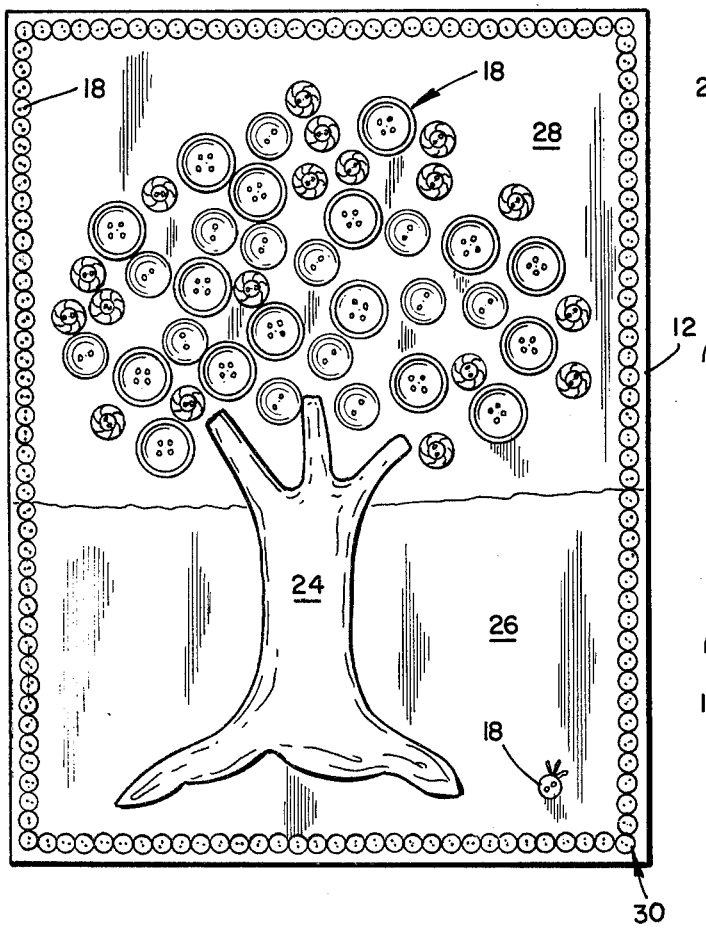
FIG. 3 shows in an enlarged scale a completed art work wherein the picture has been completed using various coloring instruments and the attachment of different size, color and shaped buttons; additionally a border or frame has been constructed using a plurality of uniform size buttons.
Figure 5:
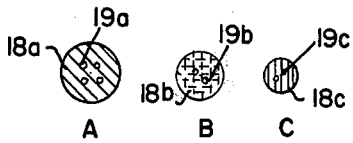
FIG. 5 shows the relative sizes and colorings of the buttons.
Figure 6:
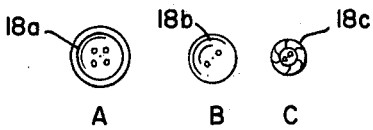
FIG. 6 illustrates in "A", "B", and "C" the various surface contours which can appear on the buttons for achieving particular effects.

The picture rendering card 12 shown in FIG. 2 contains the outline of a tree trunk 24 wherein the completion of this picture utilizing materials supplied in kit 10 is left to the creative imagination and discretion of the user. FIG. 3 shows a suggested manner in which this tree picture can be completed utilizing the buttons 18 for indicating the tree foliage. The instruments 14 may be used to color the tree trunk 24, foreground 26 and background 28 wherein various colored buttons 18A, 18B, and 18C are used to complete the picture showing, in this instance, an apple tree wherein the apple is denoted by a small red button 18C. The buttons 18 can be attached by using a fixative such as glue or paste in a manner which will be further explained hereinafter. Additionally, a plurality of contiguously spaced buttons may be placed around the border of the picture to form a margin or frame 30. A typical arrangement of the kit 10 as illustrated in FIGS. 5 and 6 can include a plurality of buttons 18A being green in color, buttons 18B being yellow in color, and buttons 18C being red in color. These buttons 18A, 18B, and 18C are preferably made of plastic and provided with a plurality of buttonholes 19A, 19B, 19C as shown and have different surface contours or designs to create an unusual three dimensional textural effect; for instance, buttons 18A and 18B show concentric ridges, while button 18C has a swirl design. Furthermore, the plastic buttons 18 usually provide a vivid color display.

Figure 4:
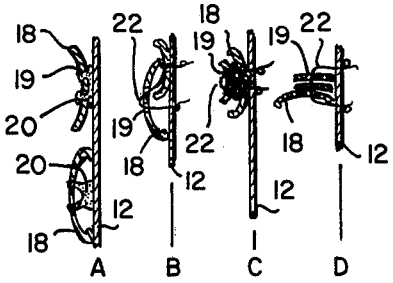
FIG. 4 is a partial sectional view showing to an enlarged scale and illustrative of the various manners in which the buttons may be attached to a picture rendering card wherein "A" shows two buttons attached as by gluing, "B" shows a plurality of buttons attached in overlapping fashion by a thread, "C" shows a plurality of buttons in a stacked fashion attached by means of a thread, and "D" shows a plurality of buttons attached in vertical alignment using a thread.

An important aspect of this invention relates to the technique for accurately positioning and securing the buttons 18 on the card 12 at the locations desired and in conformity with the picture. In this connection it should be noted that the buttons 18 might have cross sectional shapes which are convex or concave as illustrated in FIG. 4. Consequently the back of the buttons 18 will present only a small button surface area for contact with and adhesion to the substantially planar surface of the card 12. Furthermore, the buttons may at times be placed with their faces toward the card 12, thus only providing surface contact substantially around the edge periphery of the buttons 18. In order, therefore, to achieve a positive bonding action for firmly securing the button 18 to the card 12 it has been found that an effective interlocking action can be accomplished by applying or inserting a liquid cement or adhesive 20 through an aperture or buttonhole 19 while holding the button 18 at the desired location. The adhesive 20 flows through the buttonhole 19 and onto the surface of card 12 as shown in FIG. 4A. The optimum application of adhesive 20 will fill the buttonhole 19 and overlap the top edge of the buttonhole. Preferably the buttons 18 are provided with recessed buttonholes 19, and a clear, colorless, relatively quick-setting, flowable adhesive is used. The buttons 18 can be released after the adhesive 20 has initially set. A typical liquid adhesive which can be used is available under the trademark Duco cement.

While the method just described is particularly effective in permitting accurate placement of the buttons 18, an alternate method may be applied and found useful especially when using a smaller diameter button 18 having narrow opening buttonholes; for this purpose the adhesive 20 may be first deposited on the card 12 and the button 18 may then be placed over the adhesive 20 and pressure applied to cause the adhesive 20 to flow up into the buttonhole 19. Although buttons 18 can have one or more buttonholes 19, it has been found that a sufficiently effective bonding action is provided by filling only one of the buttonholes 19; however, with larger or heavier buttons and different bonding agents it may be necessary to utilize more than one hole for effective bonding. It should also be mentioned that the buttons 18 can be affixed on top of or juxtaposed with other buttons 18 and attached to the card 12 in the same manner as just described.

It should be further noted that this method of attaching the buttons 18 provides for accurate positioning and reduces the possibilities of accidentally dripping adhesive 20 on the card 12 or of using excessive amounts of adhesive 20 which would make a messy and unattractive appearance.

An alternate technique is illustrated in FIG. 4 (B, C, and D) wherein the buttons 18 are attached to the card 12 using a length of fiber, filament or thread 22 secured to the card 12 with an end thereof passing through at least one aperture 19 of each button 18. Three typical arrangements of buttons 18 are shown in section with the buttons 18 affixed to the card 12. FIG. 4B illustrates a plurality of buttons 18 in an overlapping arrangement; FIG. 4C shows the buttons 18 stacked horizontally; and FIG. 4D shows the buttons 18 aligned vertically; in each instance the buttons are held by thread 22.

It should be apparent that a combination of the aforementioned methods may be applied for attaching the buttons 18 to a single card 12. Further, other methods may become obvious to those skilled in the art, and other small objects, aside from buttons, can be provided with apertures effecting the same positive interlocking action.

As other possible embodiments may be made of the present invention and as various changes may be applicable to the embodiments as set forth, it is to be understood that all matter described herein or shown in the accompanying drawings is to be interpreted as illustrative and not in the limiting sense.

Having thus described the invention, there is claimed as new and desired to be secured by Letters Patent:

1. A picture kit for providing educational entertainment and for developing arts and crafts skills, the kit comprising at least one picture rendering card means for composing a picture, said card means having indicia on a surface for depicting an incomplete picture, said kit further including a plurality of buttons for cooperative attachment to the card means at designated areas on the card surface with the buttons forming an integral and artistic part of the completed picture, said buttons having at least one aperture therethrough, button securing means for attaching the buttons contiguously to the card surface with an end of said aperture confronting the card surface, said securing means being a flowable adhesive material, and the method for attaching the button to the card surface includes depositing the flowable adhesive at selected locations on the card surface, placing the buttons over respective deposits of adhesive and applying pressure to the button to cause the adhesive to flow into the confronting end of at least one of said apertures and to overlap the opposite end of said aperture for achieving a positive interlocking action upon setting and for permanently holding the buttons to the card surface.

* * * * *